US007708361B2

(12) United States Patent
Yamanobe

(10) Patent No.: US 7,708,361 B2
(45) Date of Patent: May 4, 2010

(54) INKJET RECORDING APPARATUS AND INKJET RECORDING METHOD

(75) Inventor: Jun Yamanobe, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 263 days.

(21) Appl. No.: 11/902,340

(22) Filed: Sep. 20, 2007

(65) Prior Publication Data

US 2008/0174617 A1 Jul. 24, 2008

(30) Foreign Application Priority Data

Sep. 22, 2006 (JP) ..... 2006-257796

(51) Int. Cl.
*B41J 29/38* (2006.01)

(52) U.S. Cl. ..... 347/5

(58) Field of Classification Search ..... None
See application file for complete search history.

(56) References Cited

U.S. PATENT DOCUMENTS 6,561,639 B1 * 5/2003 Shimoda et al. ..... 347/101
2005/0073535 A1 4/2005 Seki et al.
2007/0153041 A1 7/2007 Seki et al.

FOREIGN PATENT DOCUMENTS

JP 6-134982 A 5/1994
JP 2005-125750 A 5/2005
JP 2006218661 A * 8/2006

OTHER PUBLICATIONS

English Abstract of JP 2006-218661 A.*

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

The inkjet recording apparatus initially deposits ink on a front surface of a recording medium and subsequently deposits ink on a rear surface of the recording medium in such a manner that images are formed by the ink on the front surface and the rear surface of the recording medium, wherein, when time after depositing the ink on a first region of the front surface of the recording medium until depositing the ink on a second region of the rear surface of the recording medium which corresponds to the first region is taken to be ΔT1 (sec) and viscosity of the ink to be deposited on the first region and the second region of the recording medium is taken to be η (mPa·sec), then the inkjet recording apparatus deposits the ink on the first region and the second region in such a manner that a following relationship is satisfied:

$$\Delta T1<0.45\times\eta.$$

12 Claims, 9 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method, and more particularly, to an inkjet recording apparatus and an inkjet recording method which are capable of recording an image (including text characters, and the like) onto both the front and rear surfaces of a recording medium. In the present specification, of the recording surfaces of a recording medium having two surfaces, the surface on which recording is carried out initially is called the "front surface" and the surface on the rear side with respect to this is called the "rear surface".

2. Description of the Related Art

In an inkjet recording apparatus having a double-side recording function, generally, an image is recorded on the front surface of a recording medium, whereupon the recording medium is inverted automatically and an image is then recorded on the rear surface of the recording medium.

In cases where images are recorded onto both surfaces of a recording medium by inverting the recording medium in this way, if recording onto the rear surface is started while the ink droplets ejected onto the front surface have not yet dried completely, then problems may arise in that the ink droplets ejected onto the front surface are transferred to the conveyance surface, the conveyance surface becomes soiled, the ink is rubbed by the conveyance surface, and the image quality declines.

Consequently, when performing double-side recording in an inkjet recording apparatus, a waiting time is provided after completing recording onto the front surface, in such a manner that recording onto the rear surface is started after the ink on the front surface has dried sufficiently.

Therefore, in a conventional inkjet recording apparatus, an appropriate waiting time is set, by altering the waiting time in accordance with the type of recording paper (see, for example, Japanese Patent Application Publication No. 6-134982) or by altering the waiting time in accordance with the volume of ink droplets ejected onto the front surface (see, for example, Japanese Patent Application Publication No. 2005-125750).

In this way, by providing a waiting time after completing recording onto the front surface, it is possible to prevent soiling of the conveyance surface and deterioration of image quality, but it is not possible to resolve the following problems simply by setting a waiting time in this way. More specifically, if a waiting time is provided after completion of recording onto the front surface, the solvent component of the ink droplets ejected onto the front surface permeates into the recording medium and thereby local distortion of the medium occurs. If an image is then recorded onto the rear surface of a recording medium in which local distortions have occurred in this way, the shape of the ink is disrupted from a perfect circular shape in the portions where the distortion has occurred, and therefore the image is degraded.

SUMMARY OF THE INVENTION

The present invention has been contrived in view of these circumstances, an object thereof being to provide an inkjet recording apparatus and an inkjet recording method which are capable of recording images of satisfactory quality.

In order to attain the aforementioned object, the present invention is directed to an inkjet recording apparatus which initially deposits ink on a front surface of a recording medium and subsequently deposits ink on a rear surface of the recording medium in such a manner that images are formed by the ink on the front surface and the rear surface of the recording medium, wherein, when time after depositing the ink on a first region of the front surface of the recording medium until depositing the ink on a second region of the rear surface of the recording medium which corresponds to the first region is taken to be $\Delta T1$ (sec) and viscosity of the ink to be deposited on the first region and the second region of the recording medium is taken to be $\eta$ (mPa·sec), then the inkjet recording apparatus deposits the ink on the first region and the second region in such a manner that a following relationship is satisfied:

$$\Delta T1<0.45\times\eta.$$

In this aspect of the present invention, droplets of ink are ejected onto a corresponding region on the rear surface before the solvent component of the ink droplets ejected onto the front surface has permeated into the recording medium and given rise to local distortions in the recording medium. Therefore, it is possible to prevent the shape of the ink dots from being disturbed from a perfect circular shape. Consequently, it is possible to record images of satisfactory quality.

Preferably, when time after depositing the ink on the first region of the front surface of the recording medium until contact between the first region and a member is taken to be $\Delta T2$ (sec), then the inkjet recording apparatus adjusts the $\Delta T2$ (sec) in such a manner that a following relationship is satisfied: $\Delta T2>1$.

In this aspect of the present invention, it is possible to prevent degradation of image quality caused by the ink droplets ejected onto the front surface coming into contact with a member before drying, causing transfer of the ink to the member and rubbing of the ink.

Preferably, the inkjet recording apparatus comprises: a $\Delta T1$ adjustment device which adjusts the time $\Delta T1$ (sec); and an ink viscosity determination device which determines the viscosity $\eta$ (mPa·sec) of the ink to be deposited on the recording medium, wherein the time $\Delta T1$ (sec) is adjusted by the $\Delta T1$ adjustment device according to the viscosity $\eta$ determined by the ink viscosity determination device in such a manner that $\Delta T1<0.45\times\eta$ is satisfied.

In this aspect of the present invention, the time $\Delta T1$ (sec) is adjusted by the $\Delta T1$ adjustment device in accordance with the viscosity $\eta$ (mPa·sec) determined by the ink viscosity determination device in such a manner that "$\Delta T1<0.45\times\eta$" is satisfied. Consequently, even if the viscosity $\eta$ (mPa·sec) of the ink changes, it is still possible to record images of high quality at all times.

Preferably, the ink viscosity determination device comprises: an ink temperature determination device which determines temperature t (° C.) of the ink to be deposited on the recording medium; and a viscosity calculation device which calculates the viscosity $\eta$ (mPa·sec) of the ink to be deposited on the recording medium according to the temperature t (° C.) of the ink determined by the ink temperature determination device.

In this aspect of the present invention, the viscosity $\eta$ (mPa·sec) of the ink is determined on the basis of the temperature of the ink.

Preferably, the inkjet recording apparatus comprises an ink viscosity adjustment device which adjusts the viscosity $\eta$ (mPa sec) of the ink to be deposited on the recording medium.

In this aspect of the present invention, the viscosity $\eta$ (mPa·sec) of the ink is adjusted in such a manner that "$\Delta T1<0.45\times\eta$" is satisfied.

Preferably, the ink viscosity adjustment device adjusts temperature t (° C.) of the ink to be deposited on the recording medium so as to adjust the viscosity η (mPa·sec) of the ink to be deposited on the recording medium.

In this aspect of the present invention, the viscosity of the ink is adjusted by adjusting the temperature of the ink.

In order to attain the aforementioned object, the present invention is directed to an inkjet recording method by which images are formed by ink on a front surface and a rear surface of a recording medium, the inkjet recording method comprising the steps of: depositing the ink initially on the front surface of the recording medium; and depositing the ink subsequently on the rear surface of the recording medium, wherein, when time after depositing the ink on a first region of the front surface of the recording medium until depositing the ink on a second region of the rear surface of the recording medium which corresponds to the first region is taken to be ΔT1 (sec) and viscosity of the ink to be deposited on the recording medium is taken to be η (mPa·sec), then the ink is deposited on the first region and the second region in such a manner that a following relationship is satisfied: $\Delta T1<0.45\times\eta$.

In this aspect of the present invention, in cases where printing onto the rear surface of a recording medium is carried out after printing onto the front surface of the recording medium is carried out in order to print images on both the surfaces of the recording medium, printing onto both the surfaces of the recording medium is carried out in such a manner that "$\Delta T1<0.45\times\eta$" is satisfied. In this way, droplets of ink are ejected onto a corresponding region on the rear surface before the solvent component of the ink droplets ejected onto the front surface has permeated into the recording medium and given rise to local distortions in the recording medium. Therefore, it is possible to prevent the shape of the ink dots from being disturbed from a perfect circular shape. Consequently, it is possible to record images of satisfactory quality.

Preferably, when time after depositing the ink on the first region of the front surface of the recording medium until contact between the first region and a member is taken to be ΔT2 (sec), then the ink is deposited on the front surface and the rear surface of the recording medium in such a manner that a following relationship is satisfied: $\Delta T2>1$.

In this aspect of the present invention, since images are printed on both surfaces of a recording medium in such a manner that "$\Delta T2>1$" is satisfied, it is possible to prevent ink deposited on the front surface from making contact with a member before drying. Thus, it is possible to prevent the degradation of images caused by transferring of the ink to the member or rubbing the ink.

Preferably, the inkjet recording method further comprises the step of determining the viscosity η (mPa·sec) of the ink to be deposited on the recording medium, wherein the time ΔT1 (sec) is adjusted according to the determined viscosity η (mPa·sec) of the ink to be deposited on the recording medium in such a manner that $\Delta T1<0.45\times\eta$ is satisfied.

In this aspect of the present invention, the viscosity η (mPa·sec) of the ink to be deposited onto the recording medium can be determined, and the time ΔT1 can be adjusted according to the determined viscosity η (mPa·sec) of the ink in such a manner that "$\Delta T1<0.45\times\eta$" is satisfied. Thus, images of good quality can be recorded all the time even if the viscosity η (mPa·sec) of the ink is changed.

Preferably, temperature t (° C.) of the ink to be deposited on the recording medium is determined, and the viscosity η (mPa·sec) of the ink to be deposited on the recording medium is determined according the determined temperature t (° C.) of the ink to be deposited on the recording medium.

In this aspect of the present invention, the temperature t (° C.) of the ink to be deposited on a recording medium can be determined, and the viscosity η (mPa sec) of the ink is determined on the basis of the determined temperature t (° C.) of the ink.

Preferably, $\Delta T1<0.45\times\eta$ is satisfied by adjusting the viscosity η (mPa·sec) of the ink to be deposited on the recording medium, in such a manner that the images are formed by the ink on the front surface and the rear surface of the recording medium.

In this aspect of the present invention, the viscosity η (mPa·sec) of the ink is adjusted in such a manner that "$\Delta T1<0.45\times\eta$" is satisfied.

Preferably, the viscosity η (mPa·sec) of the ink to be deposited on the recording medium is adjusted by adjusting temperature t (° C.) of the ink to be deposited on the recording medium.

In this aspect of the present invention, by adjusting the temperature t (° C.) of the ink to be deposited on a recording medium, the viscosity η (mPa·sec) of the ink to be deposited on the recording medium can be adjusted.

According to an inkjet recording apparatus and an inkjet recording method relating to the present invention, the occurrence of distortion in the recording medium is prevented and therefore it is possible to record images of good quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
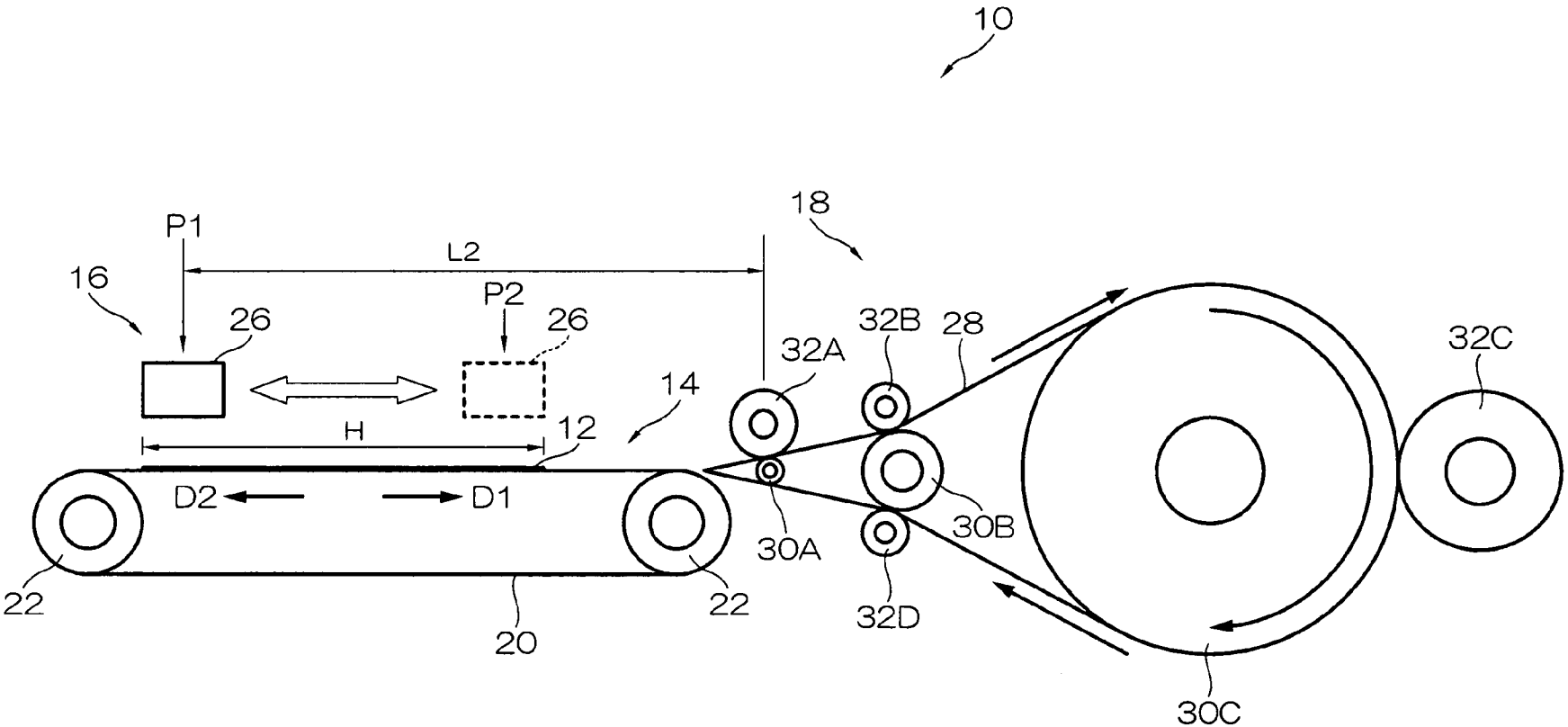
FIG. 1 is a schematic drawing showing the general composition of an inkjet recording apparatus relating to a first embodiment of the present invention.

FIG. 1 is a schematic drawing showing the general composition of an inkjet recording apparatus relating to a first embodiment of the present invention.

The inkjet recording apparatus 10 is an inkjet recording apparatus which is capable of recording onto both the front surface and the rear surface of a recording medium, and is principally constituted by a recording conveyance unit 14 which conveys the recording medium; a recording unit 16 which records an image by ejecting ink onto the recording medium conveyed by the recording conveyance unit 14; and an inverting section 18 which inverts the front/rear surface orientation of the recording medium.

The recording conveyance unit 14 conveys the recording paper forming the recording medium (in the present embodiment, normal paper) 12, horizontally, following the prescribed recording conveyance path. This recording conveyance section 14 is principally constituted by an endless recording conveyance belt 20 which conveys the recording paper 12, a pair of guide rollers 22, 22 about which the recording conveyance belt 20 is wound, and a conveyance motor (not shown) which drives the guide rollers 22 to rotate.

The pair of guide rollers 22, 22 is disposed horizontally at a prescribed interval apart. The endless recording conveyance belt 20 is disposed horizontally in a prescribed position by being wound about this pair of guide rollers 22, 22, and a horizontal recording conveyance path is formed on the upper surface (conveyance surface) thereof.

A conveyance motor is composed so as to be rotatable in the forward and reverse directions and is connected to one of the guide rollers 22. This guide roller 22 is driven by this conveyance motor and is caused to rotate in the forward direction or the reverse direction. By causing the guide roller 22 to rotate in the forward direction or the reverse direction, the recording conveyance belt 20 is caused to travel in the forward direction (direction D1 in FIG. 1) or the reverse direction (direction D2 in FIG. 1), and the recording paper 12 disposed on the conveyance surface of the recording conveyance belt 20 is thereby conveyed in the forward direction (D1 direction) or the reverse direction (D2 direction).

Recording paper 12 is supplied from a paper supply unit (not illustrated) to the recording conveyance unit 14, and after the completion of recording, the recording paper 12 is output to a paper output unit (not illustrated).

The recording unit 16 records an image on the recording paper 12 by ejecting ink from the recording head 26 onto the recording paper 12 conveyed horizontally by the recording conveyance unit 14.

The recording head 26 is constituted by a so-called full line type of recording head. More specifically, it is constituted by a recording head having a plurality of nozzles arranged in the breadthways direction of the recording paper 12 in the surface (ejection surface) which opposes the recording paper 12.

The nozzles are provided for each color of ink ejected from the recording head 26, and in the case of a recording head which records by means of one color only, nozzles are provided for one color. Furthermore, in the case of a recording head which implements color printing, nozzles are provided for a plurality of colors (for example, four colors of cyan, magenta, yellow and black).

Ink is ejected from the nozzles of the recording head 26 as the recording paper 12 passes below the recording head 26, thereby recording a prescribed image onto the recording surface (the surface facing toward the upper side).

Figure 2:
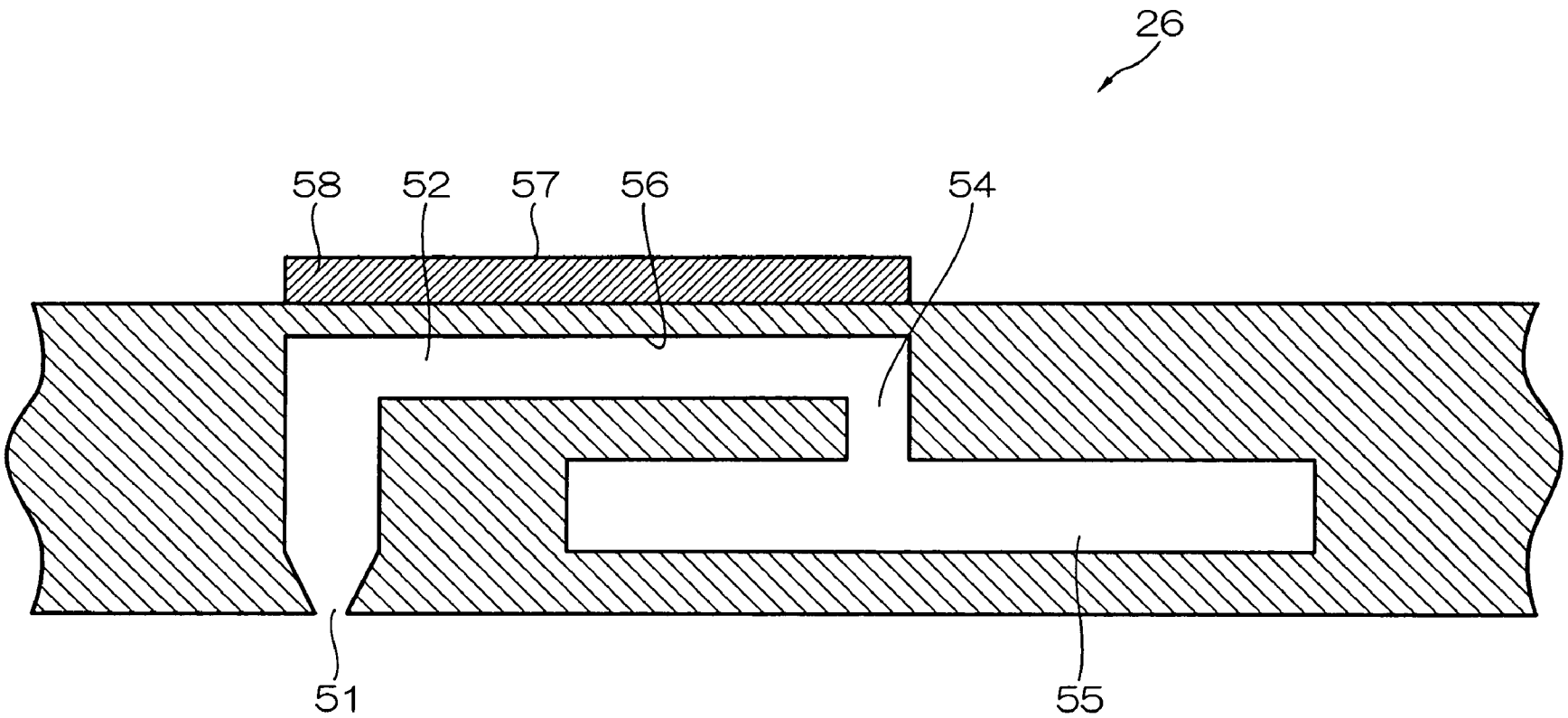
FIG. 2 is a vertical cross-sectional diagram showing the composition of the principal part of a recording head.

FIG. 2 is a vertical cross-sectional diagram showing the composition of the principal part of the recording head 26.

As described above, the recording head 26 is constituted by a full line type of recording head, and the ejection surface of the head is formed with a plurality of ejection ports (nozzles) 51 through a length corresponding to the maximum recording width of the image to be formed on the recording surface of the recording paper 12.

As shown in FIG. 2, pressure chambers 52 connected to the nozzles 51 are provided in the recording head 26, in such a manner the pressure chambers 52 respectively correspond to the nozzles 51 in one-to-one fashion. A supply port 54 is formed at one end of each pressure chamber 52, and the pressure chamber 52 is connected to a common flow channel 55 by means of this supply port 54. An ink tank (not illustrated) is connected to the common flow channel 55, and ink is supplied to the common flow channel 55 from this ink tank. Ink is supplied to the pressure chambers 52 from the common flow channel 55.

The ceiling surface of the pressure chambers 52 is constituted by a diaphragm 56, and piezoelectric elements 58 are installed on the diaphragm 56 at positions corresponding to the pressure chambers 52. An individual electrode 57 is provided on the upper surface of the piezoelectric element 58. In the present embodiment, the diaphragm 56 is constituted by a conductive material, and it also serves as a common electrode for the piezoelectric elements 58.

By adopting this composition, when a drive voltage is applied to a piezoelectric element 58, a pressure is applied to the ink in the pressure chamber 52 due to the displacement of the piezoelectric element 58, thereby causing a droplet to be ejected from the nozzle 51. After the ink ejection, new ink is supplied to the pressure chamber 52 from the common flow channel 55.

In the present embodiment, a piezoelectric type of recording head which performs ejection by using piezoelectric elements 58 is described as an example, but the implementation of the present invention is not limited to this, and it is also possible, for example, to use other types of recording heads, such as a thermal type of recording head which performs ejection by using electrical-to-thermal converter elements, such as heaters.

In the inkjet recording apparatus 10 according to the present embodiment, the recording head 26 is provided movably in the conveyance direction of the recording paper 12. In other words, the recording head 26 is supported slidably on a pair of guide shafts (not illustrated), which are disposed horizontally following the conveyance direction of the recording paper 12, and by moving the recording head 26 along these guide shafts, the position of the recording head 26 can be changed to any desired position within a prescribed range.

The recording head 26 is caused to move by means of a drive device (not illustrated), and by driving this drive device, the recording head 26 is moved horizontally in the conveyance direction of the recording paper 12.

The drive device is composed, for example, by disposing a screw shaft following the direction of the guide shafts, and engaging a nut member in a screwing action with the screw shaft, this nut member being coupled to the recording head 26. By causing the screw shaft to rotate by means of a motor, the recording head 26 is caused to move along the guide shafts. Furthermore, for example, a drive belt is wound about a pair of pulleys, the drive belt is disposed in parallel with the guide shaft, and the recording head 26 is coupled to this drive belt. By causing the pulleys to rotate by means of the motor, the drive belt is caused to travel, and the recording head 26 is moved along the guide shafts.

In this way, by making the recording head 26 movable in the conveyance direction of the recording paper 12, it is possible to adjust the time $\Delta T1$ (sec) from the ejection of droplets of ink onto the region of the front surface of the recording paper 12, until the ejection of droplets of ink onto the corresponding region on the rear surface of the recording paper 12.

The inverting unit 18 inverts the front/rear surface orientation of the recording paper 12 after recording onto the front surface side of the recording paper 12 has been completed by means of the recording unit 16. The inverting unit 18 is disposed in a continuous fashion with respect to the recording conveyance unit 14, and it is constituted by an endless inversion conveyance belt 28 which forms a conveyance path for inversion, inversion guide rollers 30A to 30C about which this inversion conveyance belt 28 is wound, inversion pressure rollers 32A to 32D which press the recording paper 12 conveyed by the inversion conveyance belt 28, a conveyance guide (not illustrated), and an inversion motor (not illustrated) which drives the rotation of the inversion guide roller 30C.

The inversion guide rollers 30A to 30C are constituted by a first inversion guide roller 30A of small diameter, a second inversion guide roller 30B of medium diameter and a third inversion guide roller 30C of large diameter, these rollers being disposed respectively at prescribed intervals apart on the line of extension with respect to the conveyance plane of the recording conveyance belt 20. The inversion conveyance belt 28 is wound about these inversion guide rollers 30A to 30B whose diameters become larger in a stepwise fashion, thereby creating a loop-shaped inversion conveyance path in continuation with the horizontal conveyance path of the recording conveyance unit 14.

The inversion pressure rollers 32A to 32D are constituted by a first inversion pressure roller 32A which is disposed at the entrance section of the inversion conveyance path, a second inversion pressure roller 32B which is disposed to the downstream side of the first inversion pressure roller 32A, a third inversion pressure roller 32C which is disposed to the downstream side of the second inversion pressure roller 32B, and a fourth inversion pressure roller 32D which is disposed to the downstream side of the third inversion pressure roller 32C.

The first inversion pressure roller 32A is disposed at a position opposing the first inversion guide roller 30A, across the inversion conveyance belt 28, and presses the recording paper 12 conveyed from the recording conveyance path, against the inversion conveyance belt 28, in such a manner that the recording paper 12 is conveyed along the inversion conveyance path.

The second inversion pressure roller 32B is disposed at a position opposing the second inversion guide roller 30B, across the inversion conveyance belt 28, and presses the recording paper 12 against the inversion conveyance belt 28, in such a manner that the recording paper 12 is conveyed along the inversion conveyance path.

The third inversion pressure roller 32C is disposed at a position opposing the third inversion guide roller 30C, across the inversion conveyance belt 28, and presses the recording paper 12 against the inversion conveyance belt 28, in such a manner that the recording paper 12 is conveyed along the inversion conveyance path.

The fourth inversion pressure roller 32D is disposed at a position opposing the second inversion guide roller 30B, across the inversion conveyance belt 28, and presses the recording paper 12 against the inversion conveyance belt 28, in such a manner that the recording paper 12 is conveyed from the inversion conveyance path.

The inversion motor drives the third inversion guide roller 30C to rotate. The inversion conveyance belt 28 travels in rotation in the clockwise direction, by means of the third inversion guide roller 30C being driven in rotation. By means of the inversion conveyance belt 28 traveling in rotation, the recording paper 12 mounted on the inversion conveyance belt 28 is conveyed along the loop-shaped inversion conveyance path, and the front/rear surface orientation is inverted during the course of this conveyance action.

The process of the image recording performed by the inkjet recording apparatus 10 according to the present embodiment having this composition is carried out in the following manner.

Firstly, the conveyance motor (not illustrated) and the inversion motor (not illustrated) are driven, and thereby the guide roller 22 is caused to rotate in the forward direction and the inversion guide roller 30C is driven to rotate in the clockwise direction. Consequently, the recording conveyance belt 20 travels in rotation in the forward direction (the D1 direction in FIG. 1), and furthermore the inversion conveyance belt 28 travels in rotation in the clockwise direction.

Next, the recording paper 12 is supplied to the recording conveyance belt 20 from a paper supply unit (not illustrated). The recording paper 12 supplied to the recording conveyance belt 20 is conveyed horizontally in a prescribed conveyance speed in the forward direction by means of the recording conveyance belt 20 which travels in the forward direction. Ink is ejected onto the recording surface (in this case the front surface of the recording paper 12) from the recording head 26, during the course of this conveyance action, thereby forming an image on the front surface. In other words, as the recording paper passes below the recording head 26, ink is ejected onto the recording surface (front surface) from the nozzles provided in the ejection surface of the recording head 26, thereby recording an image on the front surface.

The recording paper 12 on which an image has been recorded on the front surface is conveyed horizontally by the conveyance belt 20, and is guided into the inverting section 18. In other words, the recording paper 12 is guided in between the first inversion pressure roller 32A and the inversion conveyance belt 28.

The recording paper 12 guided between the first inversion pressure roller 32A and the inversion conveyance belt 28 is conveyed at a prescribed conveyance speed along the inversion conveyance path by means of the travelling inversion conveyance belt 28, while the front surface of the recording paper 12 is pressed by means of the inverting pressure rollers 32A to 32D. The front/rear surface orientation is inverted during the conveyance of the recording paper along the inversion conveyance path, and the paper is again guided to the conveyance surface of the recording conveyance belt 20.

Here, the direction of travel of the recording conveyance belt 20 is reversed while the recording paper 12 is being conveyed along the inversion conveyance path. In other words, when the recording paper 12 has been transferred completely to the inversion conveyance path, the guide roller 22 is driven to rotate in the reverse direction by the conveyance motor, and as a result of this, the direction of travel is reversed and the recording conveyance belt 20 travels in the reverse direction (the D2 direction in FIG. 1).

Consequently, the recording paper 12 guided onto the conveyance surface of the recording conveyance belt 20 from the inversion conveyance path is conveyed horizontally at a prescribed conveyance speed in the reverse direction, by means of the recording conveyance belt 20. Thereupon, ink is ejected onto the recording surface (in this case, the rear surface of the recording paper 12) from the recording head 26, during the course of this conveyance action, thereby forming an image on the rear surface. In other words, as the recording paper passes below the recording head 26, ink is ejected onto the recording surface (rear surface) from the nozzles provided in the ejection surface of the recording head 26, thereby recording an image on the rear surface.

The recording paper 12 having an image recorded on the rear surface is conveyed horizontally on the conveyance belt 20, and is guided to the paper output section (not illustrated) and is then output from the paper output section.

In this way, in the inkjet recording apparatus 10 according to the present embodiment, by automatically inverting the recording paper 12, images are recorded on both surfaces of the recording paper 12, but in this procedure, such double-side recording is carried out in such a manner that the following conditions are satisfied.

In other words, taking the time from the ejection of droplets of ink onto a region of the front surface of the recording paper 12 until the ejection of droplets of ink onto a corresponding region of the rear surface of the recording paper 12, (in other words, the region precisely to the rear of the region of the front surface), to be $\Delta T1$ (sec), and taking the viscosity of the ink ejected onto the recording paper 12 to be $\eta$ (mPa·sec), then images are recorded onto both surfaces of the recording paper 12 so as to satisfy the following relationship: $\Delta T1<0.45\times\eta$ . . . (1).

The droplet ejection time differential is controlled in the following manner. In other words, in the inkjet recording apparatus 10 according to the present embodiment, a recording head 26 is provided movably in the direction of the recording conveyance path, and therefore after completing recording on the front surface, according to requirements, the recording head 26 is moved horizontally in such a manner that recording is carried out on the rear surface side so as to satisfy the relationship (1) above. If, for example, the droplet ejection time differential is to be made shorter, the recording head 26 is set to position P1 and records onto the front surface of the recording paper 12, and when recording onto the front surface has completed, the recording head 26 is moved to the position P2 and then records onto the rear surface of the recording paper 12. By this means, it is possible to shorten the droplet ejection time differential.

In this way, by carrying out double-side recording to control the ink droplet ejection time differential so as to satisfy relationship (1) above, ink droplets can be ejected onto a corresponding region of the rear surface, before the solvent component of the ink droplets ejected onto the front surface permeates into the recording paper 12 and gives rise to local distortion of the paper, and therefore images of good quality can be recorded onto both surfaces of the recording paper 12.

Furthermore, in the inkjet recording apparatus 10 according to the present embodiment, images are recorded onto both surfaces of the recording paper 12 so as to satisfy the following condition as well.

More specifically, taking the time from the ejection of droplets of ink onto a region of the front surface of the recording paper 12 until that region makes contact with a member of any kind, to be $\Delta T2$ (sec), images are recorded onto both surfaces of the recording paper 12 in such a manner that the following relationship is satisfied: $\Delta T2>1$ . . . (2).

In the inkjet recording apparatus 10 according to the present embodiment, since the member which first makes contact with the recorded region of the front surface of the recording paper 12 after droplets of ink have been ejected onto that region is the first inversion pressure roller 32A, then the time $\Delta T2$ (sec) from the ejection of ink droplets until the ink makes contact with the first inversion pressure roller 32A is set to be longer than 1 (sec).

Here, the time until the droplets of ink ejected onto the front surface of the recording paper 12 make contact with the first inversion pressure roller 32A is controlled in the following manner, for instance. Namely, in the inkjet recording apparatus 10 according to the present embodiment, since the recording head 26 is provided movably in the direction of the recording conveyance path, then the time $\Delta T2$ (sec) after ejection of ink droplets onto the recording paper 12 until the recording paper 12 makes contact with the first inversion pressure roller 32A is controlled by adjusting the position at which the recording head 26 is disposed.

More specifically, taking the distance from the nozzles of the recording head 26 until the first inversion pressure roller 32A to be L2 (cm), and taking the conveyance speed of the recording paper 12 to be S (cm/sec), then the recording head 26 is disposed at a position where the relationship $L2/S>1$ is satisfied.

Consequently, it is possible to prevent the ink droplets ejected onto the front surface of the recording paper 12 from coming into contact with the first inversion pressure roller 32A before they have dried completely. In other words, the ejected ink droplets can be made to contact the first inversion pressure roller 32A after having dried completely. Consequently, it is possible to prevent the ink droplets ejected onto the front surface of the recording paper 12 from being transferred to the first inversion pressure roller 32A, and therefore, deterioration of quality of the recorded image caused by soiling the surface of the first inversion pressure roller 32A or rubbing the ink is avoided.

In the inkjet recording apparatus 10 according to the present embodiment, as described above, when recording images onto both surfaces of a recording paper 12, the differential between the ink droplet ejection times and the time until the ink makes contact with the first inversion pressure roller 32A are controlled so as to satisfy the relationships (1) and (2) above, and therefore it is possible, when performing the rear-side recording, to prevent the shape of the ink from being disturbed from a perfect circular shape and to prevent rubbing of the ink and transfer of the ink to contacting members. Consequently, images of satisfactory quality can be recorded onto both surfaces of the recording paper 12.

In the present embodiment, a method of moving the recording head 26 according to requirements after completing recording onto the front surface is employed as a method for controlling the differential between ink droplet ejection times, but the method of controlling the ink droplet ejection time differential is not limited to this. For example, apart from this method, it is also possible to control the ink droplet ejection time differential by controlling the conveyance speed of the recording paper 12 when it is conveyed along the inversion conveyance path.

Furthermore, in the present embodiment, a method of changing the position of the recording head 26 is employed as a method of controlling the time until ink droplets ejected onto the front surface of the recording paper 12 come into contact with the first inversion pressure roller 32A, but the method of controlling the time until ink droplets ejected onto the front surface of the recording paper 12 come into contact with the first inversion pressure roller 32A is not limited to this. For example, it is also possible to control the time until ink droplets ejected onto the front surface of the recording paper 12 come into contact with the first inversion pressure roller 32A by adjusting the conveyance speed of the recording paper 12 when it is conveyed along the recording conveyance path, for example.

Moreover, it is also possible to control the time until the ink makes contact with the first inversion pressure roller 32A by providing a waiting time after the completion of recording onto the front surface of the recording paper 12. In this case, the distance L2 from the nozzles of the recording head 26 until the first inversion pressure roller 32A is set to be longer than the length H of the recording paper 12 in the conveyance direction (i.e., L2>H). By this means, it is possible to provide a waiting time by halting the travel of the recording conveyance belt 20 after completion of recording onto the front surface of the recording paper 12, and to adjust the time until the ink makes contact with the first inversion pressure roller 32A, to any desired time.

Consequently, a desirable mode is one in which recording onto the front surface is carried out by disposing the recording head 26 in a position where the distance L2 from the nozzles of the recording head 26 to the first inversion pressure roller 32A is greater than the length H of the recording paper 12 in the conveyance direction, and after the completion of recording onto the front surface, the travel of the recording conveyance belt 20 is halted and the recording paper 12 is made to wait until the relation (2) above is satisfied. Thereupon, the recording paper 12 is guided to the inversion conveyance path, and the front/rear surface orientation of the recording paper 12 is inverted, while at the same time, the recording head 26 is moved, if necessary, and the droplet ejection is carried out so as to satisfy the relation (1) above.

Figure 3:
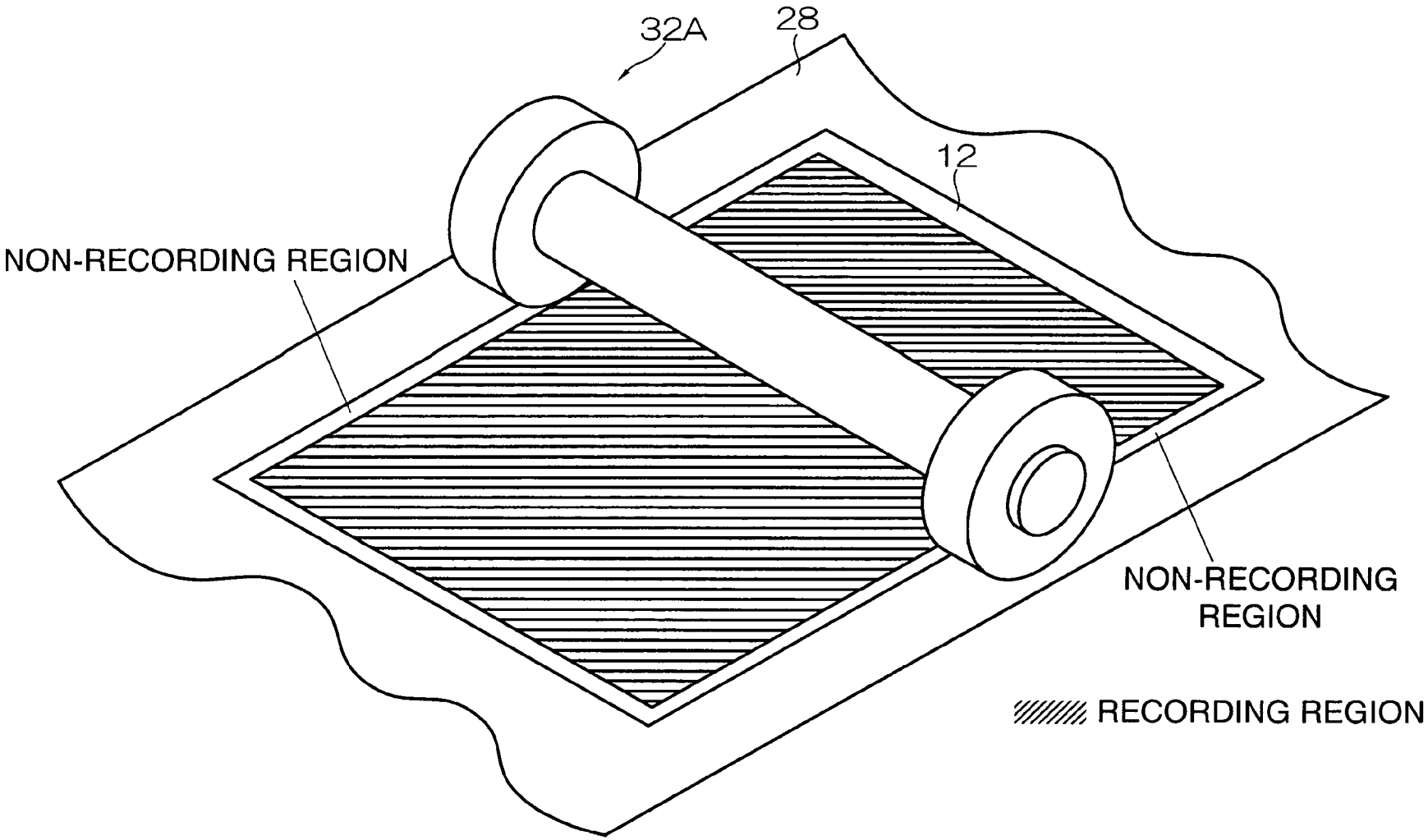
FIG. 3 is an oblique diagram showing the composition of a further embodiment of a first inversion pressure roller.

In the inkjet recording apparatus 10 according to the present embodiment, the first inversion pressure roller 32A corresponds to the member which first makes contact with the recording paper 12 after recording of the front surface, but by composing the first inversion pressure roller 32A as described below, it is possible to make the second inversion pressure roller 32B become the member which first makes contact with the recording paper 12. More specifically, as shown in FIG. 3, the first inversion pressure roller 32A adopts a composition whereby it only makes contact with non-recording regions set at either edge of the recording paper 12 (namely, regions onto which no droplets of ink are ejected). Thereby, the first inversion pressure roller 32A ceases to be the member which first makes contact with the ink after recording on the front surface, and the second inversion pressure roller 32B becomes the member which first makes contact in this way. By adopting a similar composition for the second inversion pressure roller 32B as well, it is possible to make the third inversion pressure roller 32C become the member which first makes contact with the ink.

In this way, by adopting a composition in which the inversion pressure rollers make contact with only the non-recording regions of the recording paper 12, it is possible to adjust the position at which the front surface of the recording paper 12 first comes into contact with inversion pressure rollers. By adjusting the position at which the front surface of the recording paper 12 first comes into contact with the inversion pressure rollers, it is possible to adjust the time until the surface of the recording paper 12 comes into contact with the inversion pressure rollers for the first time, after recording on the front surface.

Furthermore, a mode is also possible in which the inversion pressure rollers 32A, 32B, etc., are exchangeable, and the conveyance speed is variable, in such a manner that either a normal roller (a roller which makes contact with the region where ink droplets have been ejected on the front surface of the recording paper 12), or a roller which only makes contact with the non-recording regions as shown in FIG. 3, is installed appropriately, for the inversion pressure rollers 32A, 32B, etc., depending on the conveyance speed. A normal roller makes contact with virtually the whole surface of the recording paper 12 in the main scanning direction, and therefore it has the merit of providing good stability in the conveyance of the recording paper 12. Therefore, when the mode described above is adopted, a normal roller is used for the inversion roller in cases where the relationship (2) above is satisfied even if a normal roller is used, and a roller which makes contact only with the non-recording regions is used only in cases where the relationship (2) above is not satisfied.

Figure 4:
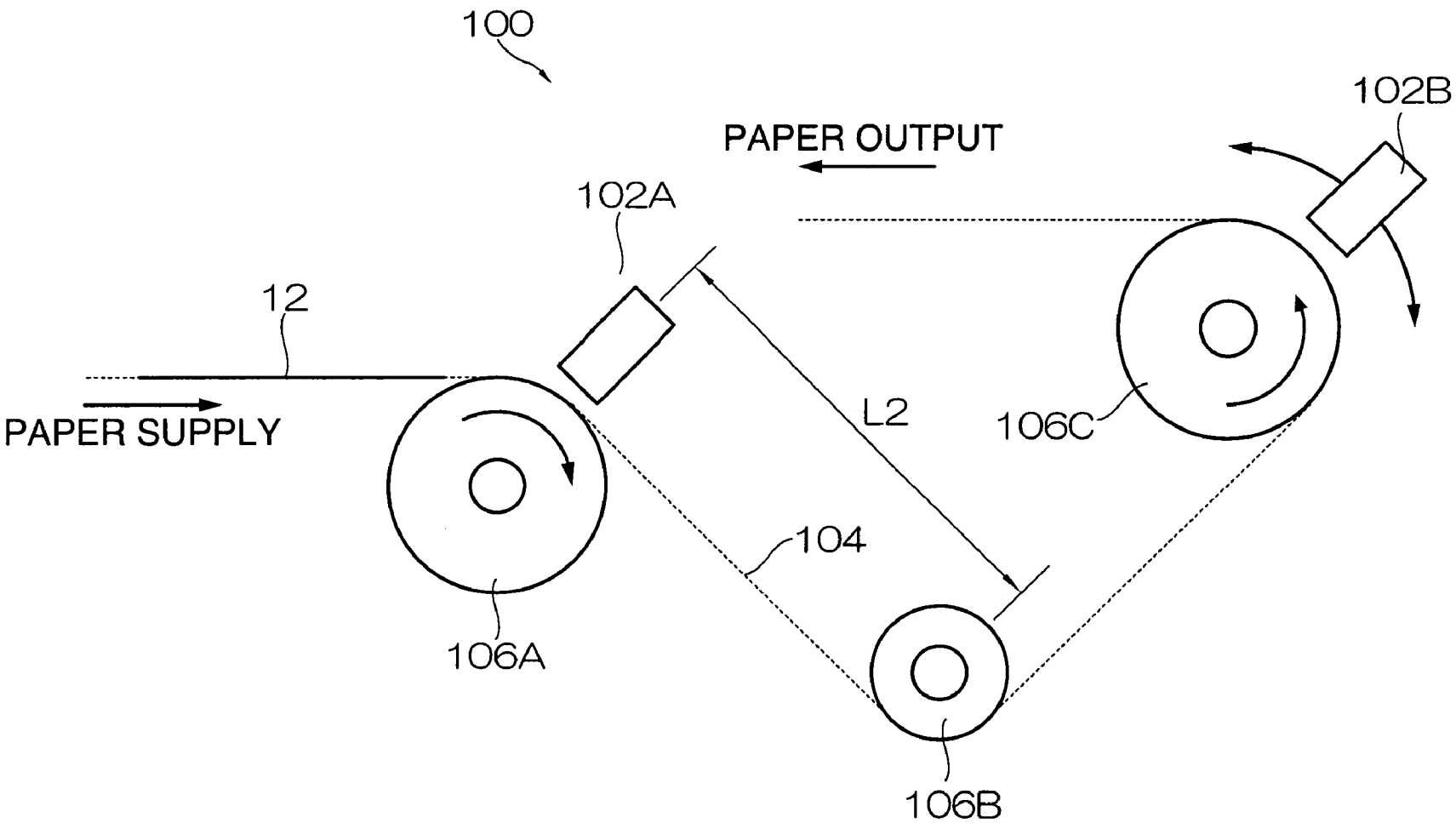
FIG. 4 is a schematic drawing showing the general composition of an inkjet recording apparatus relating to a second embodiment of the present invention.

FIG. 4 is a schematic drawing showing the general composition of an inkjet recording apparatus according to a second embodiment of the present invention.

The inkjet recording apparatus 100 according to the present embodiment records images onto both the front and rear surfaces of the recording medium, by using two recording heads. In other words, an image is recorded onto the front surface of the recording paper 12 by means of a front surface recording head 102A, and an image is recorded onto the rear surface of the recording paper 12 by means of a rear surface recording head 102B.

Furthermore, the composition of the recording head itself is the same as the recording head according to the first embodiment described above. Therefore, the description of this composition is omitted here.

The recording paper 12 is conveyed along a prescribed conveyance path 104 (the dotted line in FIG. 4) formed by a plurality of guide rollers and pressure rollers, and an image is recorded onto both the front surface and the rear surface by means of the front surface recording head 102A and the rear surface recording head 102B, during the course of this conveyance action.

FIG. 4 only shows the main guide rollers 106A to 106C.

The first guide roller (hereinafter, called "first guide roller") 106A is provided so as to oppose the front surface recording head 102A. Recording paper 12 supplied from a paper supply unit (not illustrated) is conveyed by wrapping the recording paper 12 about the first guide roller 106A, and during the course of this conveyance, ink is ejected onto the front surface by the front surface recording head 102A, thereby recording an image on the front surface.

The second guide roller (hereinafter, "second guide roller") 106B is a guide roller for inversion. The recording paper 12 having an image recorded on the front surface by means of the front surface recording head 102A is conveyed by wrapping the recording paper 12 about the second guide roller 106B, thereby inverting the front/rear surface orientation of the paper.

In the inkjet recording apparatus 100 according to the present embodiment, the second guide roller 106B is the member which first makes contact with the front surface of the recording paper 12 after recording on the front surface.

The third guide roller (hereinafter, called "third guide roller") 106C is provided so as to oppose the rear surface recording head 102B. The recording paper 12 whose front/rear surface orientation has been inverted by the second guide roller 106B is conveyed by wrapping the recording paper 12 about the third guide roller 106C, and during the course of this conveyance, ink is ejected from the rear surface recording head 102B onto the rear surface of the paper, thereby recording an image onto the rear surface.

The rear surface recording head 102B is provided swingably about the rotational axis of the third guide roller 106C, in such a manner that the ink ejection position of the head can be adjusted. In other words, the rear surface recording head 102B is provided movably over the conveyance surface for the recording paper 12 which is conveyed by wrapping around the third guide roller 106C, and it is possible to adjust the ink ejection position by altering the position in which the head is disposed.

As the method of supporting the rear surface recording head 102B in a swingable fashion in this way, it is possible, for instance, to support the head on an arm which is provided swingably about the rotational axis of the third guide roller 106C. In this case, by driving the arm so as to perform a swinging action, by means of a motor, cylinder, or the like, the rear surface recording head 102B is moved to a desired position.

The recording paper 12 on which an image has been recorded on the rear surface thereof by means of the rear surface recording head 102B is conveyed in this state to the paper output unit (not illustrated) and is then output from the paper output unit.

Motors (not illustrated) are coupled to the guide rollers 106A to 106C, and by driving these motors, the guide rollers 106A to 106C are caused to rotate (the first guide roller 106A rotates in the clockwise direction, and the second guide roller 106B and the third guide roller 106C rotate in the counter-clockwise direction), and the recording paper 12 is conveyed accordingly.

The image recording performed by the inkjet recording apparatus 100 according to the present embodiment having this composition follows the procedure described below.

Firstly, the motors (not illustrated) are driven so that the first guide roller 106A is driven to rotate in the clockwise direction and the second guide roller 106B and the third guide roller 106C are driven to rotate in the counter-clockwise direction.

Next, the recording paper 12 is supplied to the conveyance path 104 from a paper supply unit (not illustrated). The recording paper 12 supplied to the recording conveyance belt 20 is conveyed along the conveyance path 104, and ink is ejected from the front surface recording head 102A onto the recording surface (in this case, the front surface of the recording paper 12) during the course of this conveyance action, thereby recording an image on the front surface. In other words, when the recording paper 12 passes below the front surface recording head 102A while wrapping around the first guide roller 104A, ink is ejected onto the recording surface (front surface) from the nozzles provided in the ejection surface of the front surface recording head 102A, thereby recording an image onto the front surface.

The recording paper 12 having an image recorded on the front surface thereof is conveyed along the conveyance path 104 in this state and is conveyed to the second guide roller 106B for inversion. Thereupon, the paper is conveyed by wrapping around the second guide roller 106B for inversion, thereby inverting the front/rear surface orientation of the paper.

The recording paper 12 of which the front/rear surface orientation has been inverted is conveyed in this state over the conveyance path 104 and is guided to the third guide roller 106C. During the course of conveyance while wrapping about the third guide roller 106C, ink is ejected onto the recording surface (rear surface) from the nozzles provided in the ejection surface of the rear surface recording head 102B, thereby recording an image onto the rear surface of the paper.

The recording paper 12 on which an image has been recorded on the rear surface is conveyed in this state along the conveyance path 104, is guided to the paper output unit (not shown), and is output from the paper output unit.

The inkjet recording apparatus 100 according to the present embodiment forms an image on both the front surface and the rear surface of the recording paper 12 by using two recording heads, namely, the front surface recording head 102A and the rear surface recording head 102B, but similarly to the inkjet recording apparatus 10 according to the first embodiment, double-side recording is carried out so as to satisfy the prescribed conditions.

In other words, taking the time from the ejection of droplets of ink onto a region of the front surface of the recording paper 12 until the ejection of droplets of ink onto a corresponding region of the rear surface of the recording paper 12, to be $\Delta T1$ (sec), and taking the viscosity of the ink ejected onto the recording paper 12 to be $\eta$ (mPa·sec), then images are recorded onto both surfaces of the recording paper 12 so as to satisfy the following relationship: $\Delta T1<0.45\times\eta$ . . . (1).

Furthermore, taking the time from the ejection of droplets of ink onto a region of the front surface of the recording paper 12 until that region makes contact with a member of any kind, to be $\Delta T2$ (sec), images are recorded onto both surfaces of the recording paper 12 in such a manner that the following relationship is satisfied: $\Delta T2>1$ . . . (2).

Here, the ink droplet ejection time differential is controlled in the following manner in order to satisfy the relationship (1) above.

In other words, in the inkjet recording apparatus 100 according to the present embodiment, the rear surface recording head 102B is provided movably along the conveyance path 104 of the recording paper 12, and therefore if the recording paper 12 is conveyed at a prescribed conveyance speed, the rear surface recording head 102B is disposed at a position which satisfies the relationship (1) above and records onto the rear surface side from this position. For example, in order to shorten the droplet ejection time differential, the rear surface recording head 102B is moved toward the upstream side in terms of the conveyance direction of the recording paper 12, and records onto the rear surface from this position. Conversely, in order to lengthen the droplet ejection time differential, the rear surface recording head 102B is moved toward the downstream side in terms of the conveyance direction, and records onto the rear surface from this position. By this means, it is possible to adjust the droplet ejection time differential to any desired differential.

In this way, by controlling the ink droplet ejection time differential so as to satisfy the relationship (1) above to carry out double-side recording, ink droplets can be ejected onto a corresponding region on the rear surface before the solvent component of the ink droplets ejected onto the front surface permeates into the recording paper 12 and gives rise to local distortion of the paper, and therefore images of good quality can be recorded onto both surfaces of the recording paper 12.

Furthermore, the control implemented in order to satisfy the relationship (2) above is carried out as follows.

In the inkjet recording apparatus 100 according to the present embodiment, since the member which first makes contact with a recorded region on the front surface of the recording paper 12 after droplets of ink have been ejected onto that region is the second guide roller 106B, then the time $\Delta T2$ (sec) from the ejection of ink droplets until the ink makes contact with the second guide roller 106B is set to be longer than 1 (sec).

Taking the distance from the nozzles of the front surface recording head 102A to the second guide roller 106B to be L2 (cm), and taking the conveyance speed of the recording paper 12 to be S (cm/sec), this relationship is achieved by positioning the front surface recording head 102A and the second guide roller 106B so as to satisfy $L2/S>1$. Furthermore, it can be achieved by adjusting the conveyance speed of the recording paper 12.

In this way, by controlling the time until the contact is made with the front surface after ejection of ink droplets so as to satisfy the relationship (2), it is possible to prevent the ink droplets ejected onto the front surface of the recording paper 12 from coming into contact with the second guide roller 106B before the ejected ink has dried completely. Thereby, soiling the surface of the second guide roller 106B and rubbing the ink which are caused by transferring the ink droplets ejected onto the front surface of the recording paper 12 to the second guide roller 106B can be prevented, and accordingly it is possible to prevent deterioration of quality of the recorded image.

In the inkjet recording apparatus 100 according to the present embodiment, as described above, when recording images onto both the front and rear surfaces of a recording paper 12, the differential between the ink droplet ejection times and the time until the ink makes contact with the second guide roller 106B after ejection of the ink droplets are controlled so as to satisfy the relationships (1) and (2) above, and therefore it is possible to prevent the shape of the ink from being disturbed from a perfect circular shape when performing double-side recording, and to prevent rubbing of the ink or transfer of the ink to contacting members. Consequently, images of satisfactory quality can be recorded onto both surfaces of the recording paper 12.

In the present embodiment, a method of adjusting the position at which the rear surface recording head 102B is disposed is adopted as a method of controlling the differential in the ink droplet ejection times, but the method of controlling the differential in the ink droplet ejection times is not limited to this. For example, apart from this method, it is also possible to control the ink droplet ejection time differential by controlling the conveyance speed of the recording paper 12 when it is conveyed along the conveyance path 104.

Furthermore, in the present embodiment, a method of adjusting the distance between the front surface recording head 102A and the second guide roller 106B is employed as a method of controlling the time until ink droplets ejected onto the front surface of the recording paper 12 come into contact with the second guide roller 106B, but the method of controlling the time until ink droplets ejected onto the front surface of the recording paper 12 come into contact with the second guide roller 106B is not limited to this. For example, it is also possible to control the time until ink droplets ejected onto the front surface of the recording paper 12 come into contact with the second guide roller 106B by adjusting the conveyance speed of the recording paper 12 when it is conveyed along the recording conveyance path, for example.

Moreover, it is also possible to control the time until the ink makes contact with the second guide roller 106B by providing a waiting time after the completion of recording onto the front surface of the recording paper 12. In this case, the front surface recording head 102A and the second guide roller 106B are set in such a manner that the distance L2 from the nozzles of the front surface recording head 102A until the second guide roller 106B is set to be longer than the length H of the recording paper 12 in the conveyance direction (i.e., L2>H). By this means, it is possible to provide a waiting time by halting the conveyance of the recording paper 12 after completion of recording onto the front surface of the recording paper 12, and to adjust the time until the ink makes contact with the second guide roller 106B, to any desired time.

Consequently, a desirable mode is one in which recording onto the front surface is carried out by disposing the front surface recording head 102A and the second guide roller 106B in positions where the distance L2 from the nozzles of the front surface recording head 102A to the second guide roller 106B is greater than the length H of the recording paper 12 in the conveyance direction, and after the completion of recording onto the front surface, the conveyance of the recording paper 12 is halted and the recording paper 12 is made to wait until the relationship (2) above is satisfied. Thereupon, after guiding the recording paper 12 to the second guide roller 106B and inverting the front/rear surface orientation of the recording paper 12, droplet ejection is carried out by the rear surface recording head 102B so as to satisfy the relationship (1) above.

In the inkjet recording apparatus 100 according to the present embodiment, the second guide roller 106B corresponds to the member which first makes contact with the recording paper 12 after recording on the front surface, but similarly to the first embodiment described above, it is possible to avoid this by adopting the composition shown in FIG. 3. In other words, by adopting a composition in which the second guide roller 106B makes contact only with the non-recording regions set at either edge of the recording paper 12, it is possible to ensure that the member which makes contact subsequently with the front surface of the recording paper 12 is the member which first makes contact with the front surface of the recording paper 12 after ejection of ink droplets.

Furthermore, a mode is also possible in which the inversion pressure rollers 32A, 32B, etc., are exchangeable, and the conveyance speed is variable, in such a manner that either a normal roller (a roller which makes contact with the region where ink droplets have been ejected on the front surface of the recording paper 12), and a roller which only makes contact with the non-recording regions as shown in FIG. 3, are installed appropriately, for the inversion pressure rollers 32A, 32B, etc., depending on the conveyance speed. A normal roller makes contact with virtually the whole surface of the recording paper 12 in the main scanning direction, and therefore it has the merit of providing good stability in the conveyance of the recording paper 12. Therefore, when the mode described above is adopted, a normal roller is used for the inversion roller in cases where the relationship (2) above is satisfied even if a normal roller is used, whereas a roller which makes contact only with the non-recording regions is used only in cases where the relationship (2) above is not satisfied.

Moreover, in the case of the inkjet recording apparatus 100 according to the present embodiment, images are recorded onto both surfaces of a recording paper by means of two recording heads, but the composition for recording images onto both surfaces of the recording paper by means of two recording heads is not limited to this composition.

Furthermore, in the series of embodiments described above, a full line type of recording head is used for the recording head, but it is also possible to use a so-called shuttle type of recording head.

In the case of a shuttle type of recording head, a recording head is provided in a reciprocally movable fashion in a direction (main scanning direction) that is perpendicular to the conveyance direction of the recording paper (the sub-scanning direction), and ink is ejected selectively from the recording head, thereby recording an image on the recording paper, by repeating a reciprocal movement of the recording head and conveyance of the recording paper through a prescribed pitch. More specifically, image recording is carried out in the following manner.

Figure 5:
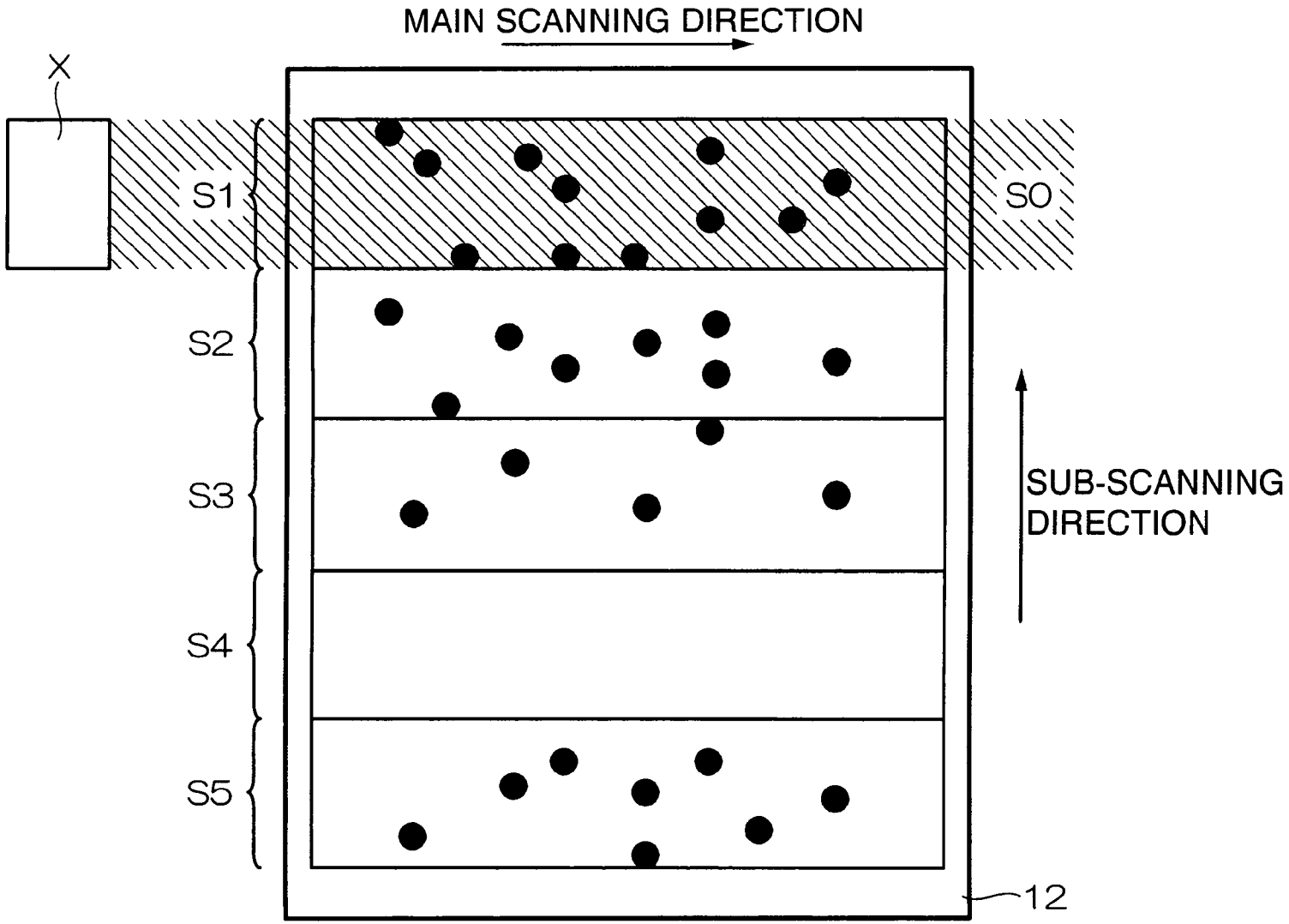
FIG. 5 is an illustrative diagram of a recording method of an inkjet recording apparatus using a shuttle type of recording head (where shingling is not used)

As shown in FIG. 5, it is supposed that the recording region of the recording paper 12 is divided into regions S1, S2, S3, and so on.

Firstly, when the region S1 has been conveyed to the main scanning direction scanning position SO of the recording head X (indicated by the shaded portion in FIG. 5), the conveyance of the recording paper 12 is temporarily halted. Thereupon, the recording head X is moved in the main scanning direction with respect to the stationary recording paper 12, and recording is carried out onto the region S1.

When recording of the region S1 has been completed, the recording paper 12 is conveyed again in the sub-scanning direction, and when the next region S2 has arrived at the main scanning direction scanning position S0, then the conveyance of the recording paper 12 is again halted temporarily. Thereupon, the recording head X is moved in the main scanning direction with respect to the stationary recording paper 12, and recording is carried out onto the region S2.

Thereafter, recording is carried out onto the whole region by repeating a similar operation.

However, as to a region where there are no pixels onto which ink droplets are to be ejected (hereinafter, called a "blank region"), even if such a blank region is conveyed to the main scanning direction scanning position S0, the conveyance of the recording paper 12 is not halted, but rather the recording paper 12 is conveyed until the next recording region arrives at S0. In the example shown in FIG. 5, the region S4 corresponds to a blank region, and when this region S4 arrives at the main scanning direction scanning position S0, rather than halting the conveyance of the recording paper 12, the recording paper 12 is conveyed until the next region S5 reaches the main scanning direction scanning position S0.

Consequently, in the case of an inkjet recording apparatus which uses a shuttle type of recording head, the time ΔT2 (sec) from the ejection of droplets onto a particular region (pixel) until that region makes contact with the first contacting member (roller, or the like) depends on the subsequent droplet ejection pattern. More specifically, if ΔT20 (sec) is taken to be the time from the ejection of droplets onto a particular region until that region makes contact with the first contacting member when there are no blank regions, then in a case where there is a blank region, the time ΔT2 (sec) is shorter than ΔT20 (sec).

Consequently, as to an image of this kind, if ΔT2<1 can be established, then before the recording paper 12 makes contact with the first contacting member, the conveyance is temporarily halted and the recording paper 12 is made to wait in such a manner that the recording paper 12 comes into contact with the first contacting member so that ΔT2 has become greater than 1 (i.e., ΔT2>1).

Thereby, the ink droplets ejected onto the front surface of the recording paper 12 are prevented from being transferred to the contacting member, and accordingly soiling the surface of the contacting member and rubbing the ink can be prevented. Therefore, it is possible to prevent deterioration of quality of the recorded image.

The foregoing description relates to a case which does not involve so-called "shingling", but a case where "shingling" is used can be considered in a similar fashion.

Here, "shingling" is a recording method in which droplet ejection is carried out in the following manner.

Figure 6:
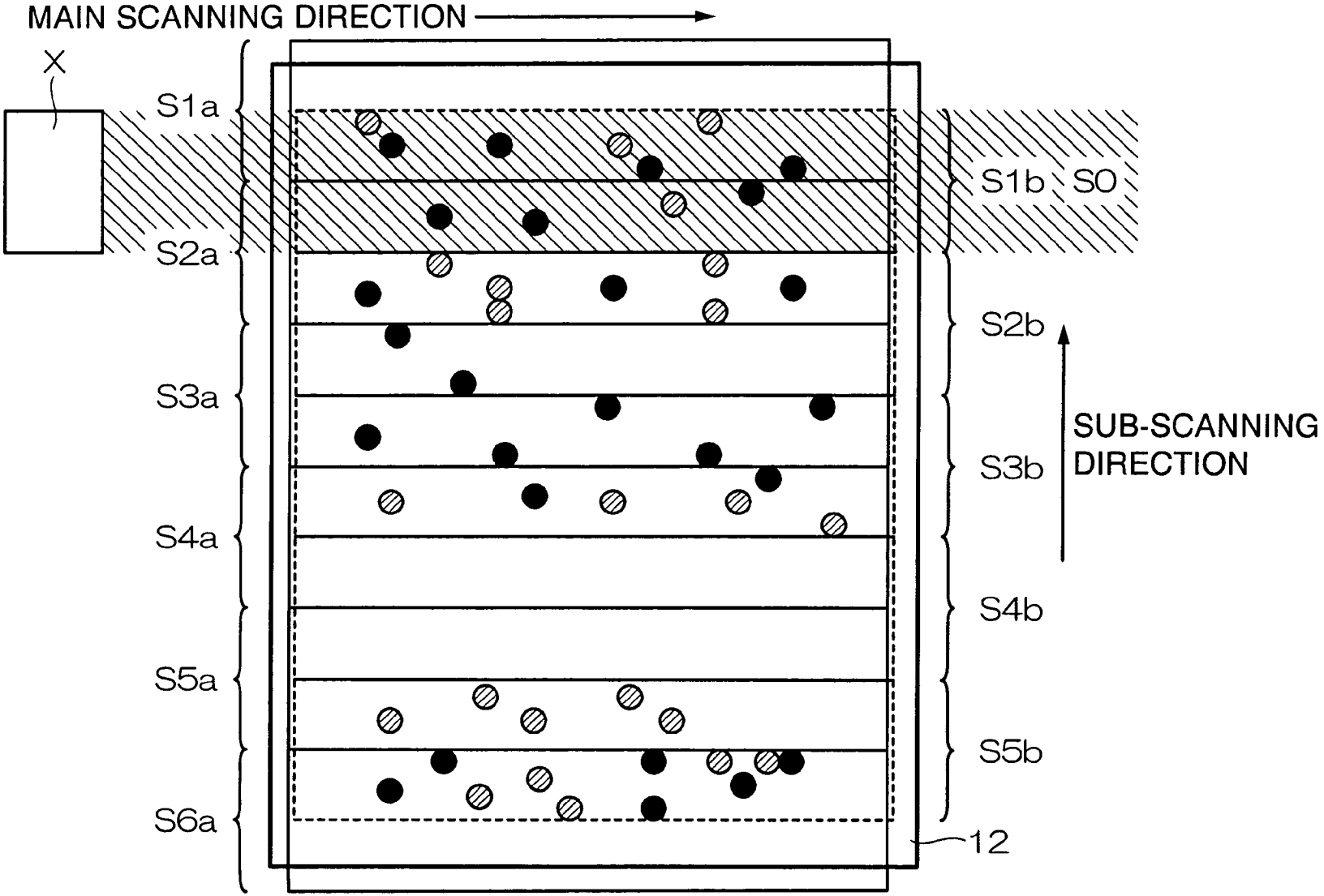
FIG. 6 is an illustrative diagram of a recording method of an inkjet recording apparatus using a shuttle type of recording head (where shingling is used)

As shown in FIG. 6, firstly, when the region S1*a* has been conveyed to the main scanning direction scanning position S0 of the recording head X (indicated by the shaded portion in FIG. 6), the conveyance of the recording paper 12 is temporarily halted. Thereupon, the recording head X is moved in the main scanning direction with respect to the stationary recording paper 12, and recording is carried out for the shaded dots (see hatched dots) in the region S1*a*.

When recording of the shaded dots in the region S1*a* has been completed, the recording paper 12 is conveyed again in the sub-scanning direction, and when the region S1*b* has arrived at the main scanning direction scanning position S0, then the conveyance of the recording paper 12 is again halted temporarily. Thereupon, the recording head X is moved in the main scanning direction with respect to the stationary recording paper 12, and recording is carried out for the full dots in the region S1*b*. The shaded dots and the full dots are of the same color.

When recording of the full dots in the region S1*b* has been completed, the recording paper 12 is conveyed again in the sub-scanning direction, and when the region S2*a* has arrived at the main scanning direction scanning position S0, then the conveyance of the recording paper 12 is again halted temporarily. Thereupon, the recording head X is moved in the main scanning direction with respect to the stationary recording paper 12, and recording is carried out for the shaded dots in the region S2*a*.

Thereafter, recording is carried out onto the whole region by repeating a similar operation.

This kind of droplet ejection method is called "shingling". By ejecting droplets of dots onto the same region in terms of the main scanning direction, from a plurality of different nozzles (from two nozzles in the case described above), it is possible to reduce bleeding caused by ejection direction errors from the nozzles.

In cases where shingling is carried out in this way also, a recording operation is not carried out with respect to blank regions and only a paper conveyance action is performed. In other words, if there is a blank region, then when the blank region arrives at the main scanning direction scanning position S0 of the recording head X, the conveyance of the recording paper 12 is not halted, but rather the recording paper 12 is conveyed until the next recording region arrives at S0. In the example shown in FIG. 6, the regions S3*a* and S4*b* correspond to blank regions, and when these regions S3*a* and S4*b* arrive at the main scanning direction scanning position S0, the conveyance of the recording paper 12 is not halted and the recording paper 12 is conveyed until the next regions S3*b* and S5*a* reach the main scanning direction scanning position S0.

Consequently, in the case of a shingling operation also, the time ΔT2 (sec) from the ejection of droplets onto a particular region (pixel) until that region makes contact with the first contacting member (roller, or the like) depends on the subsequent droplet ejection pattern.

More specifically, if ΔT20 (sec) is taken to be the time from the ejection of droplets onto a particular region until that region makes contact with the first contacting member when there are no blank regions, then in a case where there is a blank region, the time ΔT2 (sec) is shorter than ΔT20 (sec).

Consequently, in an image of this kind, if ΔT2<1 is established, then before the recording paper 12 makes contact with the first contacting member, the conveyance is temporarily halted and the recording paper 12 is made to wait in such a manner that the recording paper 12 comes into contact with the first contacting member so that ΔT2 has become greater than 1.

Thereby, it is possible to prevent the ink droplets ejected onto the front surface of the recording paper 12 from being transferred to the contacting member, and therefore to prevent soiling the surface of the contacting member and rubbing the ink. Consequently, it is possible to prevent deterioration of quality of the recorded image.

In this way, the present invention is not limited to an inkjet recording apparatus which uses a full line type of recording head, and it may also be applied to an inkjet recording apparatus which uses a shuttle type of recording head, in which case similar beneficial effects can be obtained.

In the present embodiment, the time ΔT1 (sec) varies with the viscosity η (mPa·sec) of the ejected ink, but since the viscosity η (mPa·sec) of the ink varies with the temperature of the ink, then it is possible to determine an accurate value of the viscosity by measuring the ink temperature t (° C.). In other words, the ink temperature t (° C.) is measured, and the viscosity η (mPa·sec) can be determined on the basis of the measured ink temperature t (° C.) with reference to a prescribed function or a prescribed table.

In this case, the temperature t (° C.) of the ink ejected can be determined, for example, by providing a contact type of thermometer (such as a resistance thermometer or a thermocouple) or a non-contact type of thermometer (such as a radiation thermometer) in the ink tank which stores ink or in the pressure chambers of the recording head.

The following methods may be adopted in order to determine the viscosity η (mPa·sec), apart from a mode where the viscosity η (mPa·sec) is calculated on the basis of the ink temperature t (° C.) as described above. In other words, there are a mode in which the viscosity η (mPa·sec) of the ink used is measured by a normal viscosity measurement apparatus and this value is input by a user via an operating screen; and a mode where information relating to the ink is recorded on an ink cartridge, by means of an IC chip, or the like, and when the user has installed the ink cartridge on the recording head, the recording apparatus reads in the viscosity information from the information relating to the ink.

Furthermore, in this way, the viscosity η (mPa·sec) of the ink varies with the ink temperature, and therefore it is possible to adjust the viscosity η (mPa·sec) by adjusting the temperature of the ink. For example, the ink temperature is determined, and the ink temperature is adjusted in such a manner that the viscosity becomes a desired ink viscosity η (mPa·sec) with reference to an ink temperature/viscosity table. Consequently, it is possible to adjust the viscosity η (mPa·sec) of the ink ejected.

Therefore, it is also possible to adjust the time ΔT1 (sec) so as to satisfy the above relationship (1), even by adjusting the ink viscosity η (mPa·sec).

The temperature of the ink may be adjusted by disposing heaters (for example, heating bodies) in the ink tank or the pressure chambers to heat the ink. Apart from this, it is also possible to dispose a Peltier device in the ink tank or the pressure chambers, and to adjust the ink temperature by heating or cooling the ink.

The methods of adjusting the ink viscosity η (mPa sec) is not limited to the methods described above, and it is also possible to adjust the ink viscosity by changing the composition of the ink. For example, it is also possible to adjust the viscosity η (mPa·sec), by altering the concentration of the glycerine contained in the ink (the concentration by weight percentage), and furthermore, it is also possible to adjust the viscosity η (mPa·sec) by altering the concentration of other materials (for example, diethylene glycol, or the like).

PRACTICAL EXAMPLES

The following experiments were carried out in order to confirm the beneficial effects of embodiments of the present invention.

Experiment A

Double-side recording was carried out while changing the time ΔT1 (sec) from ejection of ink droplets onto the region of the front surface of the recording paper until ejection of ink droplets onto a corresponding region of the rear surface, and the viscosity η (mPa·sec) of the ink ejected onto the recording medium; and the shape of the ink droplets ejected onto the rear surface was investigated.

Figure 7:
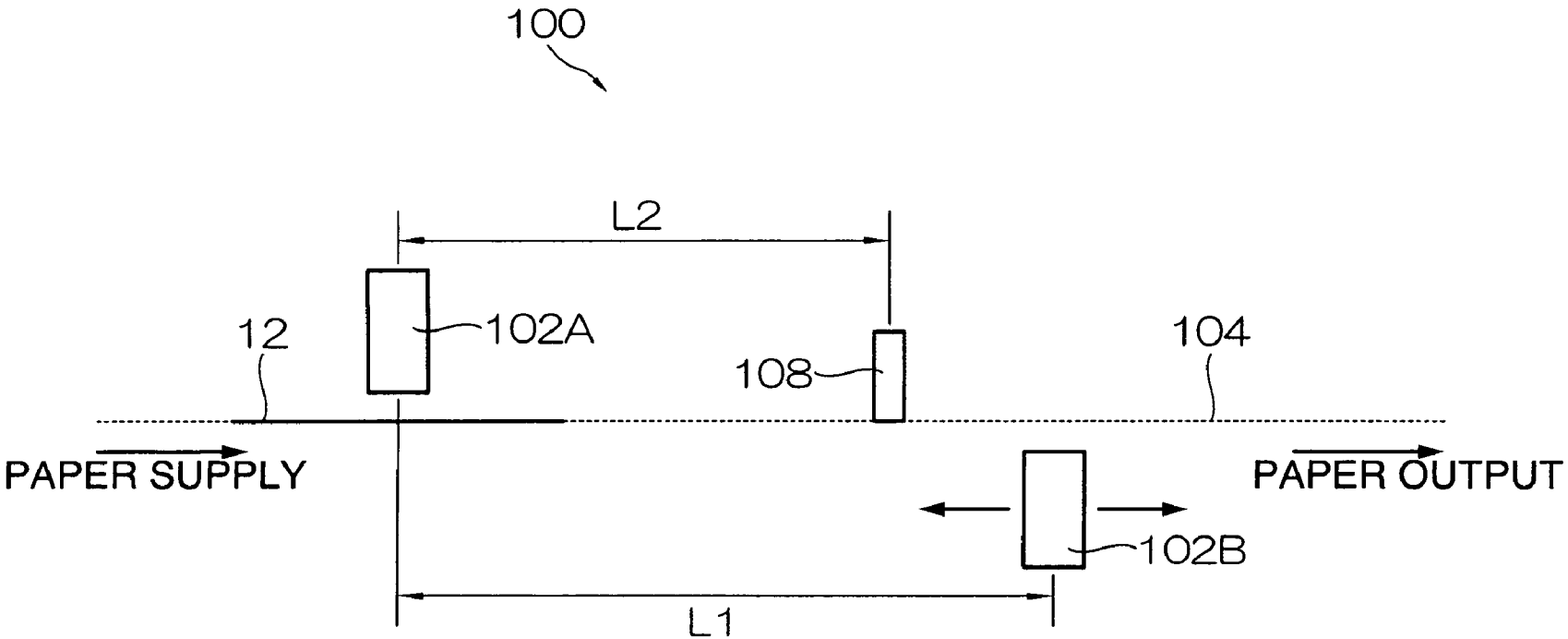
FIG. 7 is a schematic drawing showing the general composition of an inkjet recording apparatus relating to a further embodiment of the present invention.

The inkjet recording apparatus having the composition shown in FIG. 7 was used in the experiment. In other words, a horizontal conveyance path 104 was formed, and the front surface recording head 102A and the rear surface recording head 102B were disposed respectively above and below the conveyance path 104 (across the conveyance path 104). In this system, the front surface recording head 102A was disposed to the upstream side of the conveyance path 104 in terms of the conveyance direction, and the rear surface recording head 102B was disposed to the downstream side. The rear surface recording head 102B was composed so as to be horizontally movable following the conveyance path 104.

Furthermore, the time ΔT1 (sec) was adjusted by altering the conveyance speed V (cm/sec) and the conveyance distance L1 (cm) (the distance through which the recording paper was conveyed after ejection of ink droplets onto the region in the front surface of the recording paper until ejection of ink droplets onto the corresponding region in the rear surface of the recording paper).

Figure 8:
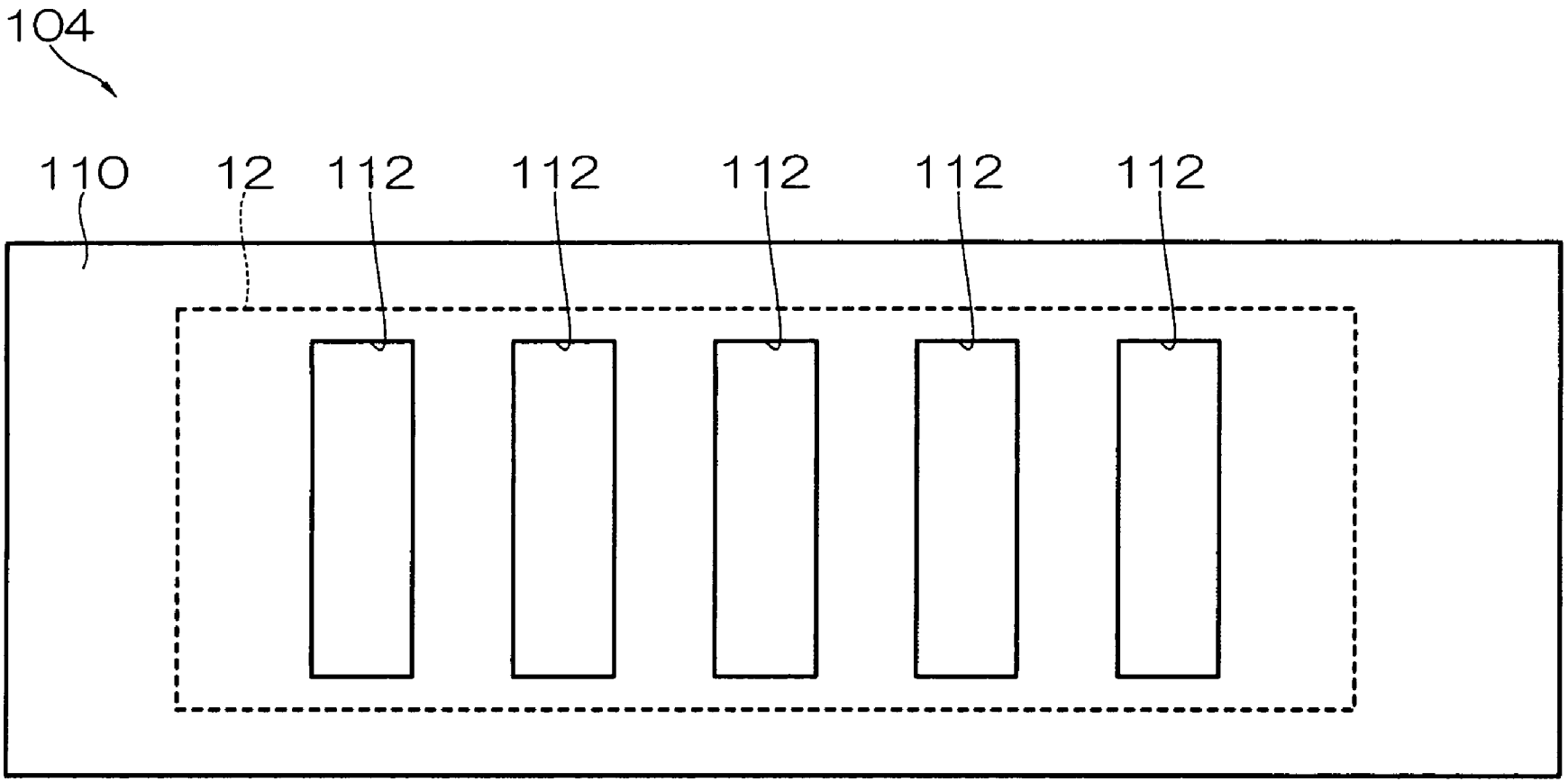
FIG. 8 is a plan diagram showing one example of a conveyance path.

As shown in FIG. 8, the conveyance path 104 was constituted by a flat plate 110, for example, and by forming opening sections 112 in this flat plate 110, a composition was achieved in which ink could be ejected onto both the surfaces of a recording paper 12 which was conveyed on the flat plate 110.

Table 1 shows the relationship between the conveyance speed V (cm/sec), the conveyance distance L1 (cm) and the time ΔT1 (sec) according to the present experiment (or the relationship between the conveyance speed V (cm/sec), the conveyance distance L2 (cm) and the time ΔT2 (sec) according to the subsequent experiment).

TABLE 1

Relationship between conveyance speed V (cm/sec), conveyance distance L1 (cm) and time ΔT1 (sec)

| CONVEYANCE DISTANCE L1 (or L2) (cm) | CONVEYANCE SPEED V (cm/sec) | TIME ΔT1 (or ΔT2) (sec) |
|---|---|---|
| 5 | 5 | 1 |
| 5 | 2.5 | 2 |
| 10 | 2 | 5 |
| 10 | 1.25 | 8 |

Furthermore, an ink having the following composition was used.

| | |
|---|---|
| Cyan pigment PB 15:3 (copper phthalocyanine): | 5 wt % |
| Olfine: | 1 wt % |
| Glycerine: | See Table 2 below |
| Water: | Balance (Remain) |

In the present experiment, the viscosity η (mPa·sec) was adjusted by changing the weight percentage concentration of the glycerine.

TABLE 2

Relationship between concentration of glycerine (wt %) and viscosity η (mPa · sec)

| | WEIGHT % CONCENTRATION OF GLYCERINE (wt %) | VISCOSITY η (mPa · sec) |
|---|---|---|
| INK A | 30.0 | 4.1 |
| INK B | 40.0 | 8.0 |
| INK C | 50.0 | 11.9 |
| INK D | 55.0 | 15.7 |

NPI high-grade paper manufactured by Nippon Paper Industries was used as the recording paper forming the recording medium.

The shape of the ink droplets ejected onto the rear surface was examined by observing the dots through a microscope, and calculating the dot shape coefficient k (where k is defined as $k=L^2/4\pi S$, taking L to be the perimeter length of the dot and S to be the surface area of the dot; in the case of a circle, k takes a minimum value, i.e. "k=1", and as the shape is disturbed from a circular shape, the value of k becomes larger.)

The shape coefficient k of the dots formed by droplets ejected onto the rear surface of the recording paper was evaluated and awarded a verdict of "Not Good" if it was greater by 0.5 or more than the dot shape coefficient in the case of single-side recording, a verdict of "Good" being awarded in all other cases. These results are shown in Table 3 below.

TABLE 3

Table showing results of Experiment A

| | | VISCOSITY η (mPa · sec) | | | |
|---|---|---|---|---|---|
| | | 4 | 8 | 12 | 16 |
| TIME ΔT1 (sec) | 8 | Not Good | Not Good | Not Good | Good |
| | 5 | Not Good | Not Good | Good | Good |
| | 2 | Not Good | Good | Good | Good |
| | 1 | Good | Good | Good | Good |

From these experiment results, it is observed that if the time ΔT1 (sec) from the ejection of droplets of ink onto a region of the front surface of the recording paper until the ejection of droplets of ink onto the corresponding region on the rear surface of the recording paper becomes larger, then the fine "distortion" (undulation) of the paper surface increases, and the dots on the rear surface are disturbed from a perfect circular shape. It was confirmed that this tendency became particularly marked as the viscosity of the ink becomes lower.

It was also confirmed that in order to prevent disturbance of the dot shapes of this kind, the condition specified in the present invention should be satisfied, in other words, "ΔT1<0.45×η" should be satisfied.

Experiment B

Double-side recording was carried out while changing the time ΔT2 (sec) from the ejection of ink droplets onto a region of the front surface of the recording medium until that region comes into contact with a member, and the viscosity η (mPa·sec) of the ink ejected onto the recording medium. The bleeding of the ink ejected onto the front surface was observed visually.

In the experiment, similarly to the Experiment A described above, an inkjet recording apparatus having the composition shown in FIG. 7 was used and the time ΔT2 (sec) was adjusted by changing the conveyance speed V (cm/sec) and the distance L2 (cm) from the recording head to the blade 108.

Similarly to Experiment A, Table 1 shows the relationship between the conveyance speed V (cm/sec) according to the present experiment, the conveyance distance L2 (cm) and the time ΔT2 (sec).

Furthermore, the ink used also had a similar composition to the ink in the Experiment A described above, and the viscosity η (mPa·sec) of the ink was adjusted by altering the wt % concentration of glycerine (see Table 2).

NPI high-grade paper manufactured by Nippon Paper Industries was used as the recording paper forming the recording medium, similarly to the Experiment A described above.

Furthermore, the liquid droplet ejection volume was taken to be 3 picoliters.

The dots formed by droplets ejected onto the front surface of the recording paper were observed through a microscope and cases where the dots had been rubbed were given a "Not Good" verdict, while all other cases were given a "Good" verdict. These results are shown in Table 4 below.

TABLE 4

Table showing results of Experiment B

| | | VISCOSITY η (mPa · sec) | | | |
|---|---|---|---|---|---|
| | | 4 | 8 | 12 | 16 |
| TIME ΔT2 (sec) | 8 | Good | Good | Good | Good |
| | 5 | Good | Good | Good | Good |
| | 2 | Good | Good | Good | Good |
| | 1 | Not Good | Not Good | Not Good | Not Good |

From the results of this experiment, it is confirmed that the dot fixing time does not depend on the viscosity η (mPa·sec) of the ink.

It is also confirmed that, in order to prevent degradation of image quality due to rubbing of the dots of this kind, the condition specified in embodiments of the present invention should be satisfied, in other words, "ΔT2>1" should be satisfied.

Figure 9:
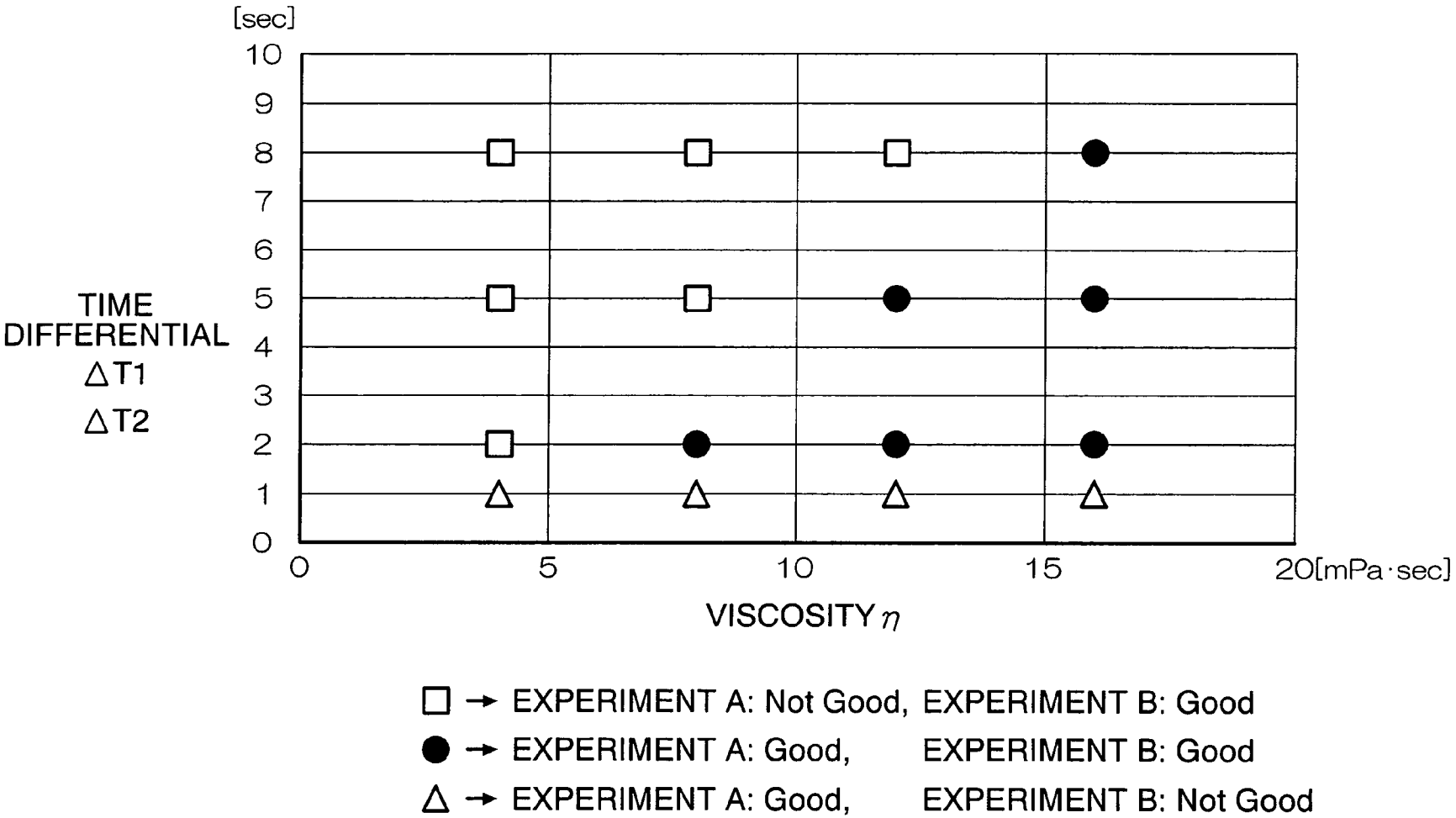
FIG. 9 is a graph showing the combined results of Experiments A and B.

FIG. 9 shows the combined results of the Experiment A and Experiment B.

In FIG. 9, the square plots indicate points where the result of Experiment A was "Not Good" and the result of Experiment B was "Good", and the triangular plots indicate points where the result of Experiment A was "Good" and the result of Experiment B was "Not Good". Furthermore, the black circular plots indicate points where the results of both Experiments A and B were "Good".

From this graph, it can be confirmed that by satisfying the two relationships specified in embodiments of the present invention, namely, "ΔT1<0.45×η" and "ΔT2>1", it is possible to prevent disturbance of the dot shape when recording onto the rear surface and to prevent rubbing of the dots during recording on the front surface, and therefore images of good image quality can be recorded.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus which initially deposits ink on a front surface of a recording medium and subsequently deposits ink on a rear surface of the recording medium in such a manner that images are formed by the ink on the front surface and the rear surface of the recording medium, wherein, when time after depositing the ink on a first region of the front surface of the recording medium until depositing the ink on a second region of the rear surface of the recording medium which corresponds to the first region is taken to be ΔT1 (sec) and viscosity of the ink to be deposited on the first region and the second region of the recording medium is taken to be η (mPa·sec), then the inkjet recording apparatus deposits the ink on the first region and the second region in such a manner that a following relationship is satisfied:

$$\Delta T1<0.45\times\eta.$$

2. The inkjet recording apparatus as defined in claim 1, wherein when time after depositing the ink on the first region of the front surface of the recording medium until contact between the first region and a member is taken to be ΔT2 (sec), then the inkjet recording apparatus adjusts the ΔT2 (sec) in such a manner that a following relationship is satisfied:

$$\Delta T2>1.$$

3. The inkjet recording apparatus as defined in claim 1, comprising:

a ΔT1 adjustment device which adjusts the time ΔT1 (sec); and an ink viscosity determination device which determines the viscosity η (mPa·sec) of the ink to be deposited on the recording medium, wherein the time ΔT1 (sec) is adjusted by the ΔT1 adjustment device according to the viscosity η determined by the ink viscosity determination device in such a manner that $\Delta T1<0.45\times\eta$ is satisfied.

4. The inkjet recording apparatus as defined in claim 3, wherein the ink viscosity determination device comprises:

an ink temperature determination device which determines temperature t (° C.) of the ink to be deposited on the recording medium; and a viscosity calculation device which calculates the viscosity η (mPa·sec) of the ink to be deposited on the recording medium according to the temperature t (° C.) of the ink determined by the ink temperature determination device.

5. The inkjet recording apparatus as defined in claim 1, comprising an ink viscosity adjustment device which adjusts the viscosity η (mPa·sec) of the ink to be deposited on the recording medium.

6. The inkjet recording apparatus as defined in claim 5, wherein the ink viscosity adjustment device adjusts temperature t (° C.) of the ink to be deposited on the recording medium so as to adjust the viscosity η (mPa·sec) of the ink to be deposited on the recording medium.

7. An inkjet recording method by which images are formed by ink on a front surface and a rear surface of a recording medium, the inkjet recording method comprising the steps of:

depositing the ink initially on the front surface of the recording medium; and depositing the ink subsequently on the rear surface of the recording medium, wherein, when time after depositing the ink on a first region of the front surface of the recording medium until depositing the ink on a second region of the rear surface of the recording medium which corresponds to the first region is taken to be ΔT1 (sec) and viscosity of the ink to be deposited on the recording medium is taken to be η (mPa·sec), then the ink is deposited on the first region and the second region in such a manner that a following relationship is satisfied:

$$\Delta T1<0.45\times\eta.$$

8. The inkjet recording method as defined in claim 7, wherein when time after depositing the ink on the first region of the front surface of the recording medium until contact between the first region and a member is taken to be ΔT2 (sec), then the ink is deposited on the front surface and the rear surface of the recording medium in such a manner that a following relationship is satisfied:

$$\Delta T2>1.$$

9. The inkjet recording method as defined in claim 7, further comprising the step of determining the viscosity η (mPa·sec) of the ink to be deposited on the recording medium, wherein the time ΔT1 (sec) is adjusted according to the determined viscosity η (mPa·sec) of the ink to be deposited on the recording medium in such a manner that $\Delta T1<0.45\times\eta$ is satisfied.

10. The inkjet recording method as defined in claim 9, wherein temperature t (° C.) of the ink to be deposited on the recording medium is determined, and the viscosity η (mPa·sec) of the ink to be deposited on the recording medium is determined according the determined temperature t (° C.) of the ink to be deposited on the recording medium.

11. The inkjet recording method as defined in claim 7, wherein $\Delta T1<0.45\times\eta$ is satisfied by adjusting the viscosity η (mPa·sec) of the ink to be deposited on the recording medium, in such a manner that the images are formed by the ink on the front surface and the rear surface of the recording medium.

12. The inkjet recording method as defined in claim 11, wherein the viscosity η (mPa·sec) of the ink to be deposited on the recording medium is adjusted by adjusting temperature t (° C.) of the ink to be deposited on the recording medium.

* * * * *